US006195944B1

(12) United States Patent
Goldthorpe

(10) Patent No.: US 6,195,944 B1
(45) **Date of Patent: *Mar. 6, 2001**

(54) LINER

(75) Inventor: Paul Goldthorpe, Wigan (GB)

(73) Assignee: Valley Industries Limited, Wigan (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/088,637

(22) Filed: Jun. 2, 1998

(51) Int. Cl.[7] ..... E02D 29/12

(52) U.S. Cl. ..... 52/19; 52/20; 52/21; 52/309.1; 52/606

(58) Field of Search ..... 52/19, 20, 21, 52/309.1, 606

(56) References Cited

U.S. PATENT DOCUMENTS 3,478,482 * 11/1969 Weir ..... 52/592.3
4,023,590 * 5/1977 Harris et al. ..... 137/363
5,362,174 * 11/1994 Yang ..... 404/25
5,386,669 * 2/1995 Almeida ..... 52/19
5,564,855 * 10/1996 Anderson ..... 52/21 X
5,956,905 * 9/1999 Weidrich ..... 52/20

FOREIGN PATENT DOCUMENTS

0310488 * 7/1985 (EP) ..... 52/20
2557899 * 7/1985 (EP) ..... 52/20
0310488 * 4/1989 (EP) ..... 52/20

* cited by examiner

*Primary Examiner*—Beth A. Stephan
*Assistant Examiner*—Brian E. Glessner
(74) *Attorney, Agent, or Firm*—Salter & Michaelson

(57) ABSTRACT

A liner for a manhole, inspection chamber or the like comprises one or more sections moulded from synthetic plastics material. The or each section comprises inner and outer skins (2,3) joined together by two series of webs (4,7) extending between and at right angles to the skins (2,3). The webs (4) are disposed at the upper edges (5,6,) of the section and the webs (7) extend between a position below those upper edges (5,6) and a position at its lower end. The upper edges (5,6) and lower periphery (9) of each section are formed so that superposed sections interlock. The arrangement provides an easily installable corrosion resistant load bearing yet light, rigid and deformation resisting structure.

8 Claims, 3 Drawing Sheets

LINER

TECHNICAL FIELD

The present invention relates to a liner. The liner is particularly, but not exclusively intended for use in manhole inspection chambers and the like.

BACKGROUND OF RELATED ART AND SUMMARY OF THE INVENTION

Liners of this general type are already known. One such is described in U.S. Pat. No. 4,751,799. It comprises a plurality of superposed sections. The liner is formed with integral T-shaped sections extending externally thereof and enabling the liner to be keyed to a surrounding mass of cast material. The liner prevents toxic materials from reaching the cast material. This arrangement is unnecessarily complex and adds to on site work.

According to the present invention there is provided a liner for a manhole, inspection chamber or the like comprising one or more sections moulded from a synthetic plastics material, the one or more each section comprising inner and outer skins joined by a system of webs to provide a substantially rigid deformation resistant structure and the opposite ends of which are formed to interlock with any adjacent section.

In a preferred embodiment of the invention, there are two series of webs. The webs of both series extend at right angles to and between the inner and outer skins. Those of a first series are located adjacent one end of the section and those of the second series extend between a position displaced from that surface and the surface at he opposite end of the section. One end of the section is rebated to form a projection which extends all the way around the periphery of the section and the other end of the section is formed in complementary manner. In this way superposed sections can be interlocked, the projection of one section interlocking with the complementary formation of the section directly adjacent it. In an installation of the liner, the lowermost section would sit on a prepared base usually of concrete and a lid would be placed over the uppermost section. The undersurface of the lid would advantageously be provided with a complementary formation to that of the upper surface of the uppermost section.

BRIEF DESCRIPTION OF THE DRAWINGS

In order that the invention may be more clearly understood one embodiment thereof will now be described by way of example with reference to the accompanying drawing, in which.

DETAILED DESCRIPTION OF THE ILLUSTRATIVE EMBODIMENT

Figure 1:
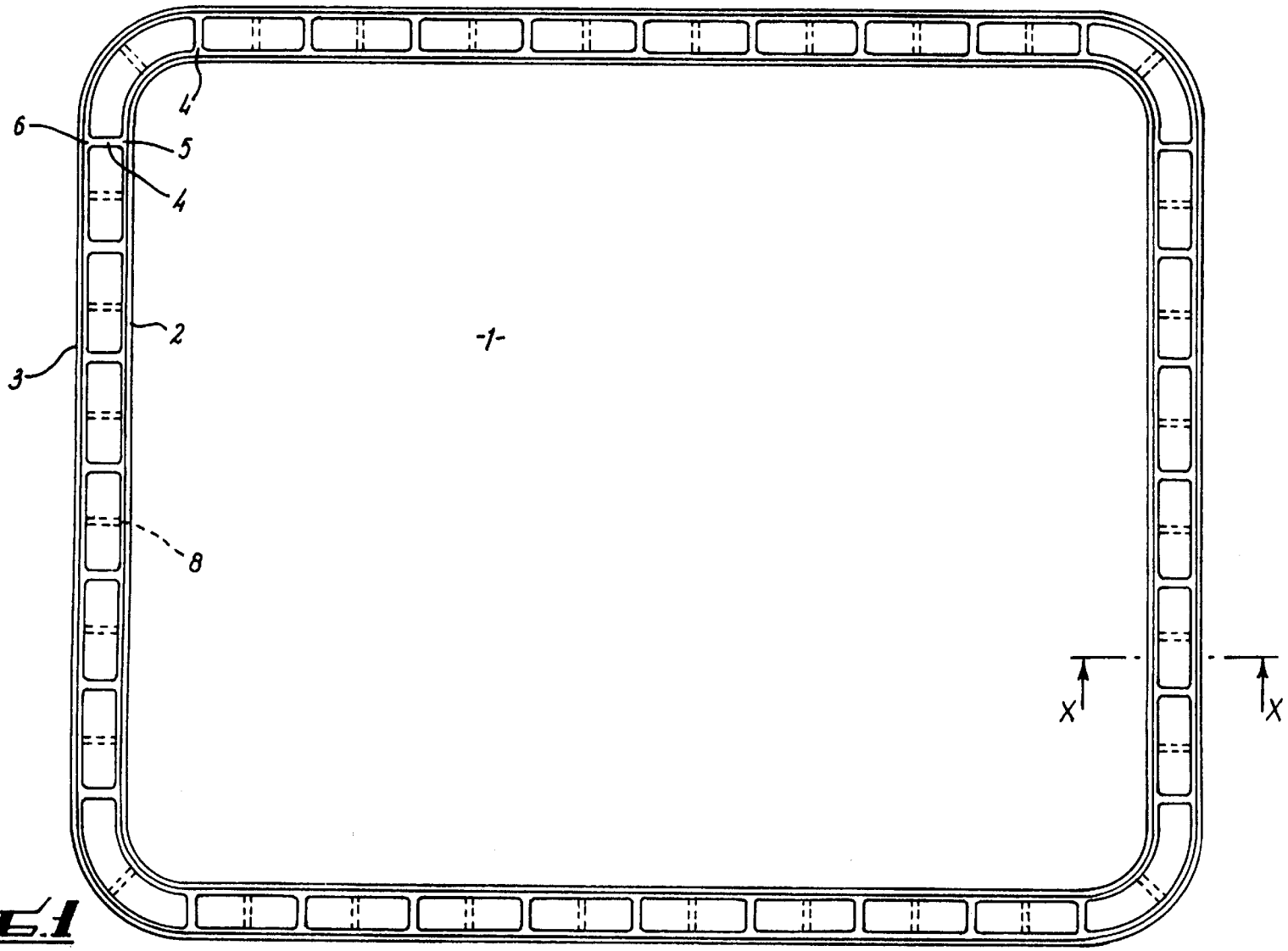
FIG. 1 is a plan view of a liner according to the invention.
Figure 2:
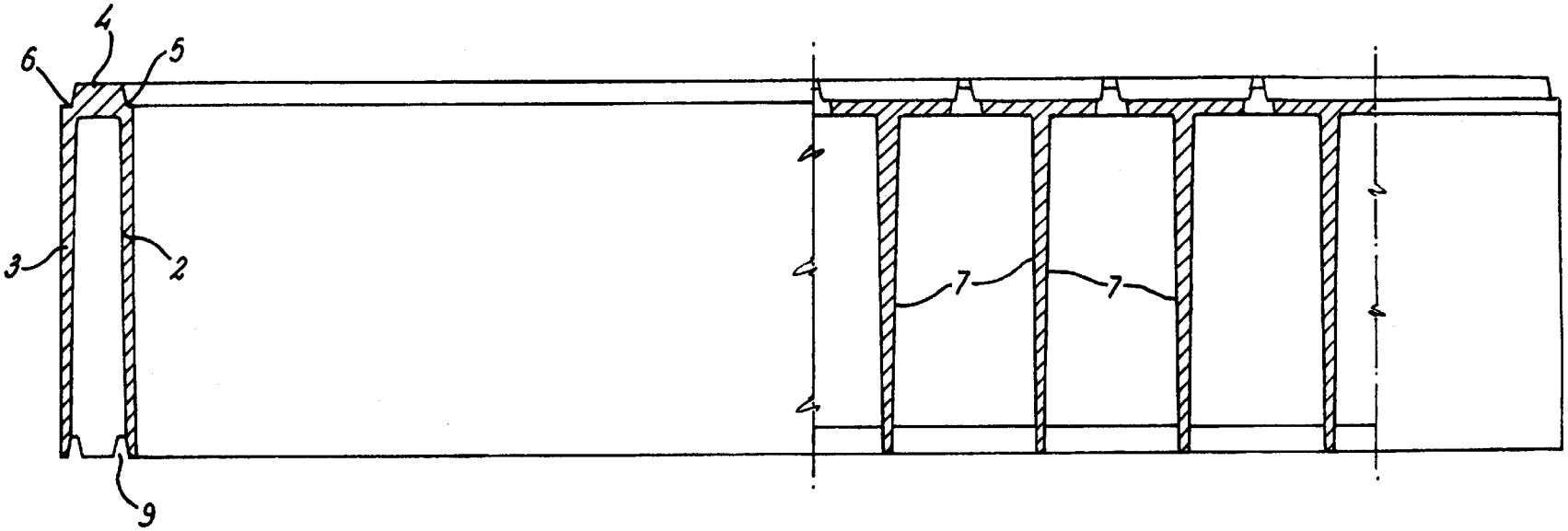
FIG. 2 is a side elevational view in partial cross-section of the upper section of the liner of FIG. 1, and FIGS. 3 to 6 are detail views in cross-section of parts of the upper section of FIG. 2.

Referring to the drawings the liner may comprise one or more sections. In the latter case, sections are superposed and fit together in a manner to be described later. The depth of the one or more each section 1 which is moulded from a suitable synthetic plastics material such as high density polythene is chosen to give a reasonably flexible arrangement consistent with current economic moulding practice.

The number of sections is chosen having regard to the depth of the hole/chamber which is to be line. Each section has a hollow open ended form. It external shape in end, side elevational or plan view may be chosen as desired.

Each section 1 comprises inner and outer skins 2 and 3 joined together by a system of reinforcing webs. This system comprises two series. The first series comprises individual webs 4 which extend between and at right angles to the inner and outer skins 2 and 3 at their upper edges 5 and 6. The second series of webs comprises individual webs 7 which also extend between and at right angles to the inner and outer skins 2 and 3. Each web 7 extends between a position at its upper end slightly below the upper most surface of the section and a position at its lower end at the lowermost surface of the section. Apart from the webs at the four corners of the section the webs 4 and 7 of both series are equidistantly spaced and the webs 4 of the first series alternate with the webs 7 of the second series. The thickness of each web 7 progressively reduces from top to bottom of the section.

Figure 3:
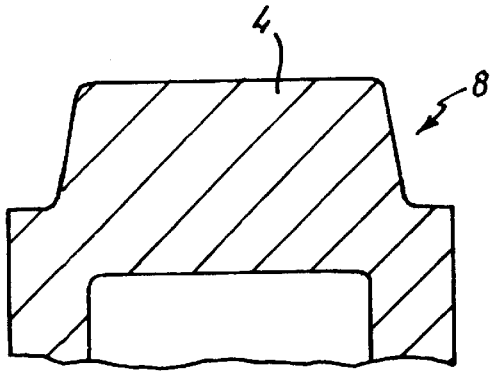
Figure 5:
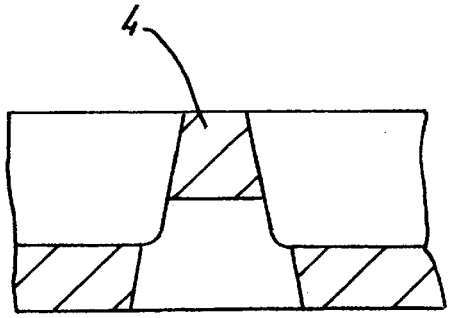
Figure 4:
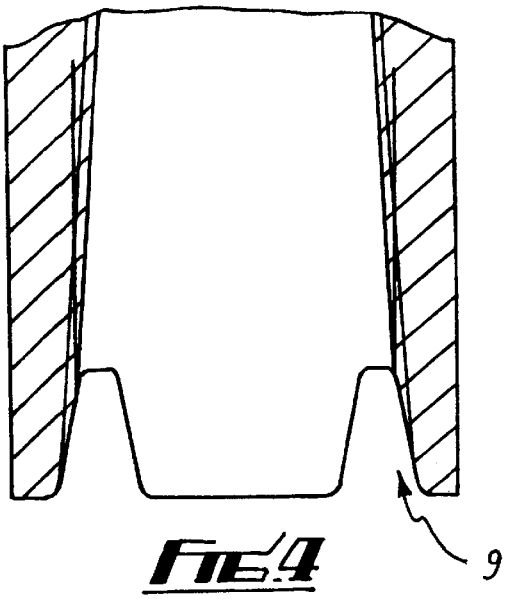
Figure 6:
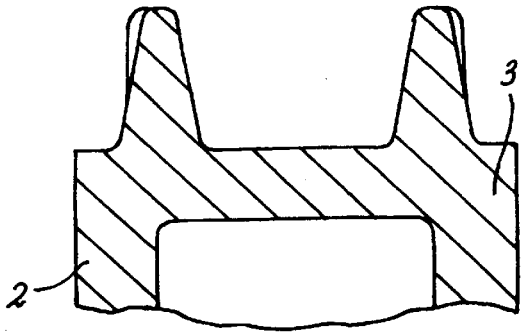

The upper edges 5 and 6 of each section are rebated to produce an interlocking projection 8 which extends wholly around the upper periphery of the section. The lower periphery 9 of the section is formed in complementary manner so that when one section is placed in superposed section on another the interlocking projection 8 of the lower section is received within the complementary periphery 9 of the section immediately about. In this manner two or more sections can be interlocked together to form a rigid liner of the required height. Detail cross-sectional view to a larger scale of a web 4/upper projection 8, and complementary formation 9 are shown in FIGS. 3 and 4 respectively. An end cross-sectional elevation of a web 4 to a larger scale is shown in FIG. 5 and a cross-section to a larger scale along the section line X—X of FIG. 1 is shown in FIG. 6.

In use after digging a hole in the ground and preparing the (usually concrete) base, section as described above are introduced to build up a liner to the desired height. The manhole/inspection chamber so lined may then be closed off by means of a (usually concrete) lid which may be formed on its undersurface with a formation similar to formation 9 to interlock with projection 8 of the uppermost section. Any peripheral unfilling may then be attended to complete the installation. If desired, the liner may be installed into pre-existing manholes/inspection chambers. The above described arrangement provides an easily installable corrosion resistant, load bearing yet light, rigid and deformation resisting structure.

It will be appreciated that the above embodiment has been described by way of example only and that many variations are possible without departing from the scope of the invention.

What is claimed is:

1. A liner for an inspection chamber comprising:

one or more sections molded from a synthetic plastics material, each section comprising inner and outer skins joined by a first series of webs and a second series of webs, each series of webs extending between the inner and outer skins so as to provide a substantially rigid deformation resistant structure with first and second opposing ends formed to interlock with any adjacent section, wherein the first series of webs alternates with and is displaced from the second series of webs, one end of the webs of the first series disposed adjacent the first end of the section, and the webs of the second series extending between a position displaced from the first end of the section to the second end of the section.

2. The liner as claimed in claim 1, in which the webs of the second series reduce in thickness from one end to the other.

3. The liner as claimed in claim 1, in which the webs extend substantially at right angles to and between the inner and outer skins.

4. The liner as claimed in claim 1, in which one end of the one or more each section is rebated to form a projection which extends around the periphery of the section and the other end of the section is formed in complementary manner.

5. In combination the liner as claimed in claim 1, and a prepared base upon which a lowermost section of the liner sits.

6. The combination as claimed in claim 5, in which the base is concrete.

7. In combination the liner as claimed in claim 1, and a lid placed over an uppermost section of the liner.

8. The combination as claimed in claim 7, in which an undersurface of the lid has a complementary formation to that of an upper surface of the uppermost section of the liner.

* * * * *